US010685633B2

(12) United States Patent
Bossert et al.

(10) Patent No.: US 10,685,633 B2
(45) Date of Patent: Jun. 16, 2020

(54) STRING INSTRUMENT BOW LIGHT

(71) Applicants: Laura A. Bossert, Lincoln, MA (US); Patricia Jancova, Essex Junction, VT (US); Geofrey Chua Cua, Lincoln, MA (US)

(72) Inventors: Laura A. Bossert, Lincoln, MA (US); Patricia Jancova, Essex Junction, VT (US); Geofrey Chua Cua, Lincoln, MA (US)

( * ) Notice: Subject to any disclaimer, the term of this patent is extended or adjusted under 35 U.S.C. 154(b) by 0 days.

(21) Appl. No.: 16/451,392

(22) Filed: Jun. 25, 2019

(65) Prior Publication Data

US 2019/0392797 A1 Dec. 26, 2019

Related U.S. Application Data

(60) Provisional application No. 62/763,649, filed on Jun. 26, 2018.

(51) Int. Cl.

| | |
|---|---|
| ***G10G 7/00*** | (2006.01) |
| ***G10D 3/16*** | (2020.01) |
| ***F21S 10/06*** | (2006.01) |
| ***F21V 33/00*** | (2006.01) |
| *F21Y 115/10* | (2016.01) |

(52) U.S. Cl.

CPC ..... *G10G 7/00* (2013.01); *F21S 10/06* (2013.01); *F21V 33/0056* (2013.01); *G10D 3/16* (2013.01); *F21Y 2115/10* (2016.08)

(58) Field of Classification Search

CPC ..... G10G 7/00; F21S 10/06; F21V 33/0056; G10D 3/16; F21Y 2115/10

See application file for complete search history.

(56) References Cited

U.S. PATENT DOCUMENTS

| | | | | |
|---|---|---|---|---|
| 3,726,177 A * | 4/1973 | Kaplan | G09B 15/06 84/470 R |
| 10,210,847 B1 * | 2/2019 | Leslie | G10D 3/16 |
| 2006/0101981 A1 | 5/2006 | Bartholomew et al. | |
| 2014/0245876 A1 | 9/2014 | Kunstadt | |

OTHER PUBLICATIONS

Kesler, "Highly Resonant Wireless Power Transfer: Safe, Efficient, and over Distance," <http://witricity.com/wp-content/uploads/2016/12/White_Paper_20161218.pdf> (2017).

* cited by examiner

*Primary Examiner* — Kimberly R Lockett

(74) *Attorney, Agent, or Firm* — Ion C. Abraham

(57) ABSTRACT

A string instrument bow light includes at least one light configured to be disposed on a length of a shaft of a string instrument bow, the length of the shaft spanning between a frog and a tip of the string instrument bow, and a power supply electrically connected to the at least one light.

24 Claims, 8 Drawing Sheets

STRING INSTRUMENT BOW LIGHT

CROSS REFERENCE TO RELATED APPLICATION

This application claims priority from U.S. Provisional Patent Application No. 62/763,649 filed on Jun. 26, 2018 entitled LIGHTED BOW SLEEVE, which is hereby incorporated by reference.

BACKGROUND

Symphony orchestras which encompass bowed string instruments, such as the violin, viola, cello, double bass, and other string instruments, frequently perform at holiday celebrations that often include fireworks or light shows. At such performances, as well as those more typically classical in nature such as chamber orchestras or string quartet concerts, transferable lights on the bows of the string instruments would artistically enhance the performance, by playing on a darkened stage, for example.

A bow for a string instrument includes a shaft or specially shaped stick with a ribbon of approximately 150 horsehairs stretched between its ends, from the tip or head of the stick to the frog, which holds and adjusts the tension of the horsehair and encloses the mechanism responsible for this action. The stick is often made of rare or expensive rainforest woods, such as Pernambuco, and the frog is typically made of ebony. Consequently, well-made, rare, and antique bows command high prices. Performers are therefore reluctant to modify their bows in any way that would mark or alter the surface of the bow, such as by applying tape or glue to the stick.

Therefore, there is a need to attach lights to a string instrument bow without marking or altering the surface of the bow in any way, with a switch to turn the lights on and off.

BRIEF SUMMARY

Various embodiments disclosed herein relate to articles and methods for attaching accessory lights to a string instrument bow. The bowed string instruments can include a violin, viola, cello, double bass, chin cello, and viola da gamba. In accordance with one or more embodiments, an article includes at least one light configured to be disposed on a length of a shaft of a string instrument bow, the length of the shaft spanning between a frog and a tip of the string instrument bow, and a power supply electrically connected to the at least one light. In some embodiments, the at least one light can be a light emitting diode (LED). In certain embodiments, the at least one light can be one light substantially spanning the length of the shaft. In certain other embodiments, the at least one light can be a plurality of lights, substantially spanning the length of the shaft. In some of these embodiments, the plurality of lights can be configured to light in a sequential pattern along the length of the shaft. In other of these embodiments, the plurality of lights can be configured to flash on and off. In certain embodiments, the plurality of lights can be uniformly spaced at least 0.5 inches, such as 1.5 inches, apart along the length of the shaft. In some embodiments, the article can further include a bow sleeve disposed over the shaft of the string instrument bow, the at least one light disposed on the sleeve along a length of the sleeve, the sleeve length being at least about 80% of the length of the shaft. In certain of these embodiments, the power supply can be attached to the bow sleeve.

In other of these embodiments, the power supply can be attached to the frog of the string instrument bow. In some of these embodiments, the article can further include a clip that clamps around the frog. In certain of these embodiments, the clip can be extended to clamp around the power supply. In some other embodiments, the power supply can be attached to the clip. In certain embodiments, the article can further include a protective layer between the clip and the frog. In some embodiments, the power supply can be integrated into a wrist band. In certain other embodiments, the article can further include at least one light clip that attaches the at least one light to the shaft of the string instrument bow. In some embodiments, the article can further include a power supply clip that attaches the power supply to the shaft of the string instrument bow.

In accordance with one or more embodiments, a method of making an article includes disposing a bow sleeve over a length of a shaft of a string instrument bow, the length of the shaft spanning between the frog and the tip of the bow, disposing at least one light on the bow sleeve along a length of the bow sleeve, the sleeve length being at least approximately 80% of the length of the shaft, electrically connecting a power supply to the at least one light, and connecting the frog to the shaft of the string instrument bow. In some embodiments, the method can further include sewing the at least one light on the sleeve, such as sewing a string of lights on the sleeve. In certain embodiments, the method can further include attaching the power supply to the frog of the string instrument bow. In other embodiments, the method can further include attaching the power supply to the bow sleeve.

A string instrument bow light artistically enhances musical performances without marking, injuring, or otherwise altering the surface of the components of the string instrument bow, such as the stick, tip, and frog.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

Figure 1A:
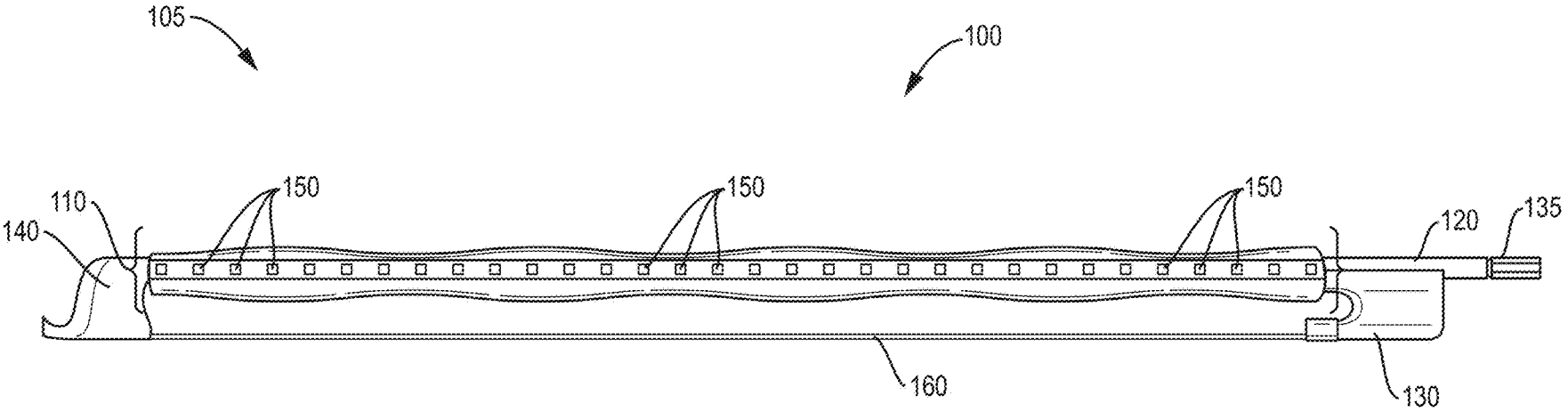
FIG. 1A illustrates a plan view of a string instrument bow light in accordance with one or more embodiments.

As stated above, various embodiments disclosed herein relate to articles and methods for attaching accessory lights to a string instrument bow. The string instrument can be one of a violin, viola, cello, double bass, chin cello, and viola da gamba. In one embodiment, as shown in FIG. 1A, a string instrument bow light 100 includes a bow sleeve 110 configured to be disposed over a length of a shaft 120 of a string instrument bow 105, the length of the shaft 120 spanning between a frog 130 and a tip 140 of the string instrument bow 105. The bow 105 also includes a ribbon 160 of approximately 150 horsehairs stretched between the tip 140 and the frog 130. The shaft or specially shaped stick 120 is typically made of rare or expensive rainforest woods, such as Pernambuco. The frog 130, which holds and adjusts the tension of the bow hair 160 and encloses the mechanism responsible for this action, is typically made of ebony. The mechanism responsible for tensioning the bow hair ribbon 160 includes a screw 135 that passes through the frog 130 and threads into an eyelet (not shown) within the shaft 120. The bow sleeve 110 is disposed over the shaft 120 when the screw 135 is entirely unscrewed from the shaft 120 and the frog 130 is detached from the shaft 120. The bow sleeve 110 is made of fabric, such as a fabric that is as light weight as possible and can stretch and thereby fit over the shaft 120. At least one light, or a plurality of lights 150, as shown in FIG. 1A, are disposed on the bow sleeve 110 along a length of the bow sleeve 110, the sleeve length being at least about 80% of the length of the shaft 120, such as about 85%, or about 90%, or about 95%, or about 100%, or any extent of the length of the shaft 120 in a range of between about 80% and about 100%. In one embodiment, a ribbon of lights 150 is sewn on the bow sleeve 110. Alternatively, the ribbon of lights 150 can be glued or otherwise attached to the bow sleeve 110.

A variety of lights are suitable for the lights 150. In one embodiment, the light 150 can be one light substantially spanning the length of the shaft 120. Alternatively, as shown in FIG. 1A, a ribbon of uniformly spaced lights 150, spaced at least 0.5" apart, such as 1.0" apart, 1.5" apart, 2.0" apart, 2.5" apart, or 3.0" apart, substantially spans the length of the shaft 120. The number of lights, their length, color, and spacing between them depends on a variety of factors, such as the desired visual effect, and the distance between the performer and the audience. The lights 150 shown in FIG. 1A are light emitting diodes (LEDs). Suitable LED ribbons are available from Inolux Corporation (Hsin-Chu, Taiwan). Suitable lights also include small holiday-type lights. Such lights or LEDs can be white lights, colored lights, or lights of at least two colors, such as red and green, or three colors, such as red, white, and blue. Depending on the desired visual effect, at least two colors can alternate along the sleeve length, and/or the plurality of lights 150 can be configured to flash on and off, or light in a sequential pattern along the sleeve length.

Figure 1B:
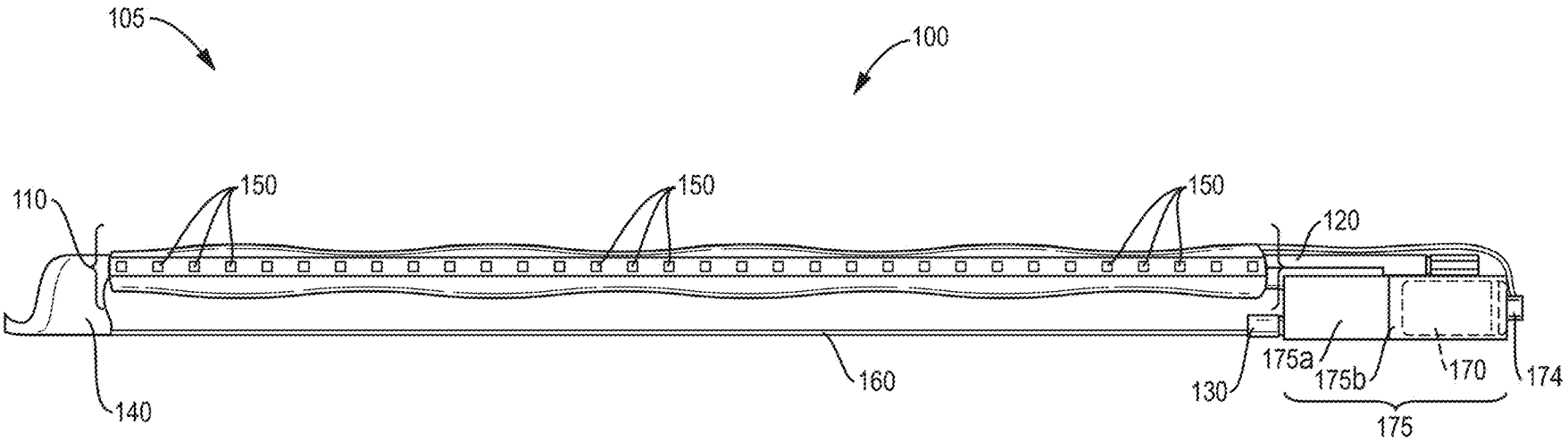
FIG. 1B illustrates a plan view of a string instrument bow light including a power supply attached to the frog of the string instrument bow in accordance with one or more embodiments.
Figure 1C:
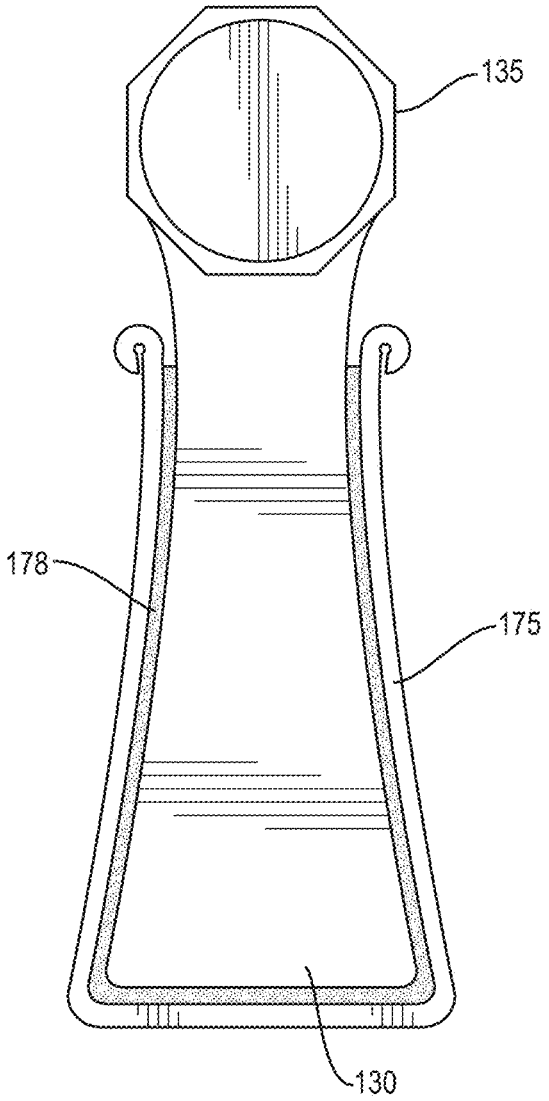
FIG. 1C illustrates an end view of a frog of the string instrument bow including a protective layer between the clip and the frog in accordance with one or more embodiments.

The string instrument bow light 100 includes a power supply 170 electrically connected to the at least one light 150. In one aspect, suitable power supplies can be assembled from a battery holder including an A23 (12 VDC) battery and an AF1683 on/off switch. Philmore (Rockford, Ill.) BH531 battery holder, Adafruit (New York, N.Y.). In one embodiment, as shown in FIG. 1B, the power supply 170 is electrically connected to the plurality of lights 150 and attached to the frog 130 of the string instrument bow 105 by a clip 175 that clamps around the frog 130. The clip 175 preferably does not mar or mark the surface of the frog 130, and so, as shown in FIG. 1C, the bow light 100 includes a protective layer 178 between the clip 175 and the frog 130. FIG. 1C also shows a front view of the screw 135. In one aspect, the protective layer 178 is a layer of rubber, cork, felt, or other resilient material having a thickness suitable to protect the surface of the frog 130, such as a thickness in a range of between about 0.5 mm and about 2 mm. Turning back to FIG. 1B, in one embodiment, the clip 175 is extended to clamp around the power supply 170. The extended clip 175 can comprise two clips 175A and 175B connected together, one clip 175A to clamp over the frog 130, and the other clip 175B to clamp over the power supply 170. FIG. 1B also shows the on/off switch 174 of the power supply 170, the bow sleeve 110, and the ribbon of lights 150 disposed over a length of the shaft 120 of a string instrument bow 105, the length of the shaft 120 spanning between a frog 130 and a tip 140 of the string instrument bow 105.

Figure 2:
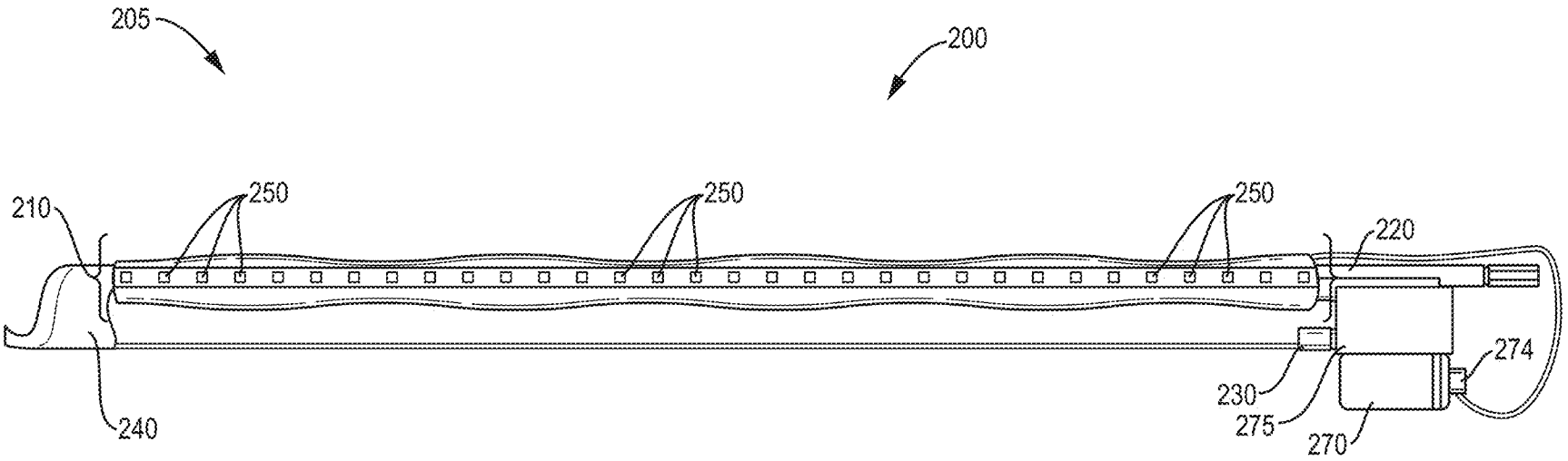
FIG. 2 illustrates a plan view of a string instrument bow light including a power supply attached to a clip that clamps around the frog of the string instrument bow in accordance with one or more embodiments.

In another embodiment, shown in FIG. 2, a string instrument bow light 200 includes a power supply 270 that is attached to the clip 275 that clamps around the frog 230. In some aspects, the power supply 270 is attached to the clip 275 with glue, double stick tape, Velcro, or magnets. FIG. 2 also shows the on/off switch 274 of the power supply 270, the bow sleeve 210, and the ribbon of lights 250 disposed over a length of the shaft 220 of a string instrument bow 205, the length of the shaft 220 spanning between a frog 230 and a tip 240 of the string instrument bow 205.

Figure 3:
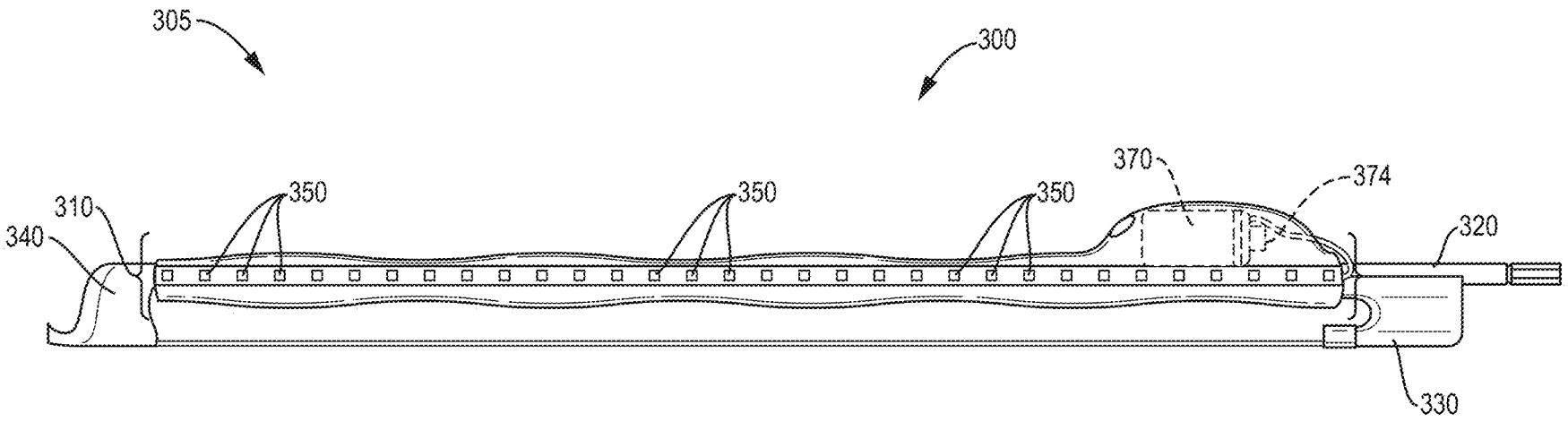
FIG. 3 illustrates a plan view of a string instrument bow light including a power supply attached to the bow sleeve in accordance with one or more embodiments.

In still another embodiment, shown in FIG. 3, a string instrument bow light 300 includes a power supply 370 that is attached to the bow sleeve 310, on the side of the bow sleeve 310 nearest the frog 330, in one example embodiment approximately 4 to 5 inches from the frog 330, depending on the size of the performer's bow hand (e.g., right hand). In some aspects, the power supply 370 is attached to the bow sleeve 310 by sewing the power supply 370 on top of the bow sleeve 310, as shown in FIG. 3. In another aspect (not shown), the bow sleeve 310 is stretched over the power supply 370, optionally including a small hole in the bow sleeve 310 for access to the on/off switch 374. FIG. 3 also shows the on/off switch 374 of the power supply 370, and the ribbon of lights 350 disposed over a length of the shaft 320 of a string instrument bow 305, the length of the shaft 320 spanning between the frog 330 and a tip 340 of the string instrument bow 305.

Figure 4:
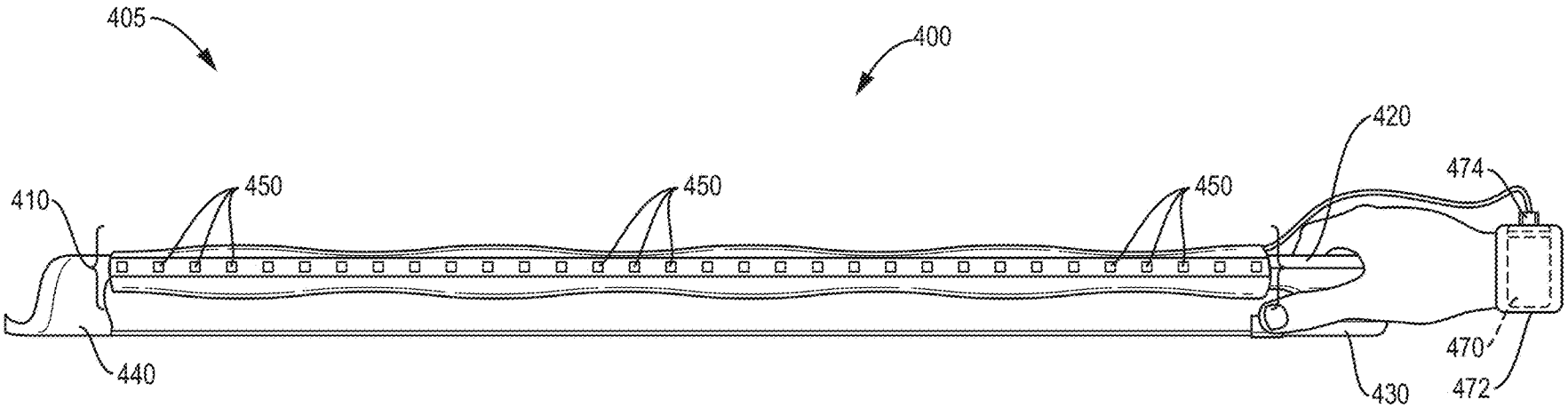
FIG. 4 illustrates a plan view of a string instrument bow light including a power supply integrated into a wrist band in accordance with one or more embodiments.

In yet another embodiment, shown in FIG. 4, a string instrument bow light 400 includes a power supply 470 that is integrated into a wrist band 472. FIG. 4 also shows the on/off switch 474 of the power supply 470, and the bow sleeve 410 with the ribbon of lights 450 disposed over a length of the shaft 420 of a string instrument bow 405, the length of the shaft 420 spanning between a frog 430 and a tip 440 of the string instrument bow 405. In this embodiment, the power supply 470 can be electrically connected wirelessly (not shown) to the lights 450. See A. B. Kurs, A. Karalis, R. Moffatt, J. D. Joannopoulos, P. H. Fisher, and M. Soljacic, "Wireless Power Transfer via Strongly Coupled Magnetic Resonances", Science, 317, pp. 83-86, (2007), the entire contents of which are hereby incorporated by reference for all purposes.

Figure 5A:
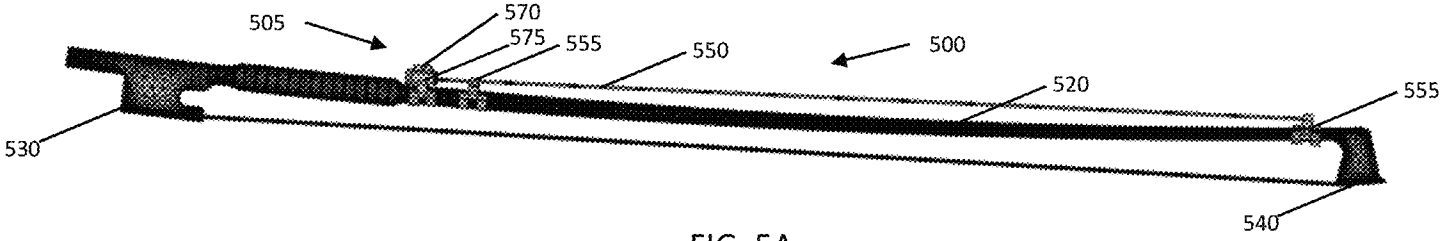
FIG. 5A illustrates a plan view of a string instrument bow light including a power supply attached to a power supply clip and a string of lights attached to light clips, such that each clamp around the shaft of the string instrument bow in accordance with one or more embodiments.
Figure 5C:
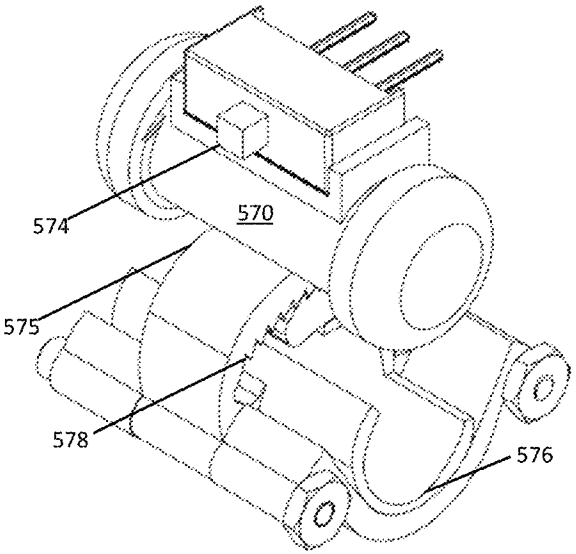
FIG. 5C illustrates a perspective view of the power supply attached to the power supply clip in accordance with one or more embodiments.
Figure 5D:
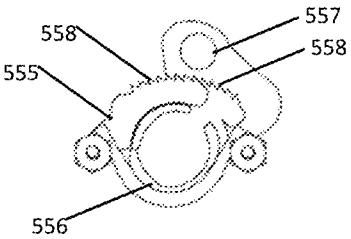
FIG. 5D illustrates an end view of the light clip in accordance with one or more embodiments.
Figure 5B:
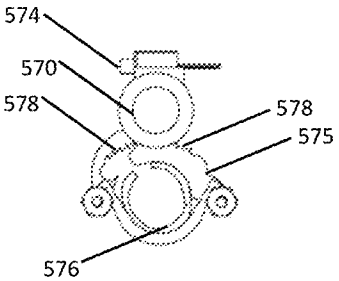
FIG. 5B illustrates an end view of the power supply attached to the power supply clip in accordance with one or more embodiments.

In still another embodiment, shown in FIGS. 5A-5D, a string instrument bow light 500 includes a power supply 570 that is attached to a power supply clip 575 that clamps around the shaft 520 and thereby attaches the power supply 570 to the shaft 520 of the string instrument bow 505. The on/off switch 574 of the power supply 570 is shown in FIGS. 5B and 5C. The string of lights 550 is disposed over a length of the shaft 520 of the string instrument bow 505, the length of the shaft 520 spanning between a frog 530 and a tip 540 of the string instrument bow 505. The string of lights 550 is attached to at least one light clip 555, two light clips 555 shown in FIG. 5A, one proximal to the power supply 570, and the other proximal to the tip 540. Multiple light clips 555 can be used to attach the string of lights 550 to the shaft 520 of the string instrument bow 505. The light clip 555, shown in more detail in FIG. 5D, includes an eyelet 557 that captures the string of lights 550, such as a suitably sized string of LED lights 550. The light clip 555 and the power supply clip 575 can each vary in size to accommodate different diameters of the shaft 520, and each size of the light clip 555 and the power supply clip 575 can adjust to different diameters of the shaft 520 by virtue of the interlocking teeth 558 and 578, respectively. A variety of manufacturing processes, such as injection molding or 3-D printing can be used to make the light clip 555, power supply 570, and power supply clip 575. As shown in FIGS. 5D and 5B-5C, the light clip 555 and the power supply clip 575 can each optionally include a protective layer 556 and 576, respectively, such as a layer of rubber, cork, felt, or other resilient material having a thickness suitable to protect the surface of the shaft 520, such as a thickness in a range of between about 0.5 mm and about 2 mm.

Figure 6:
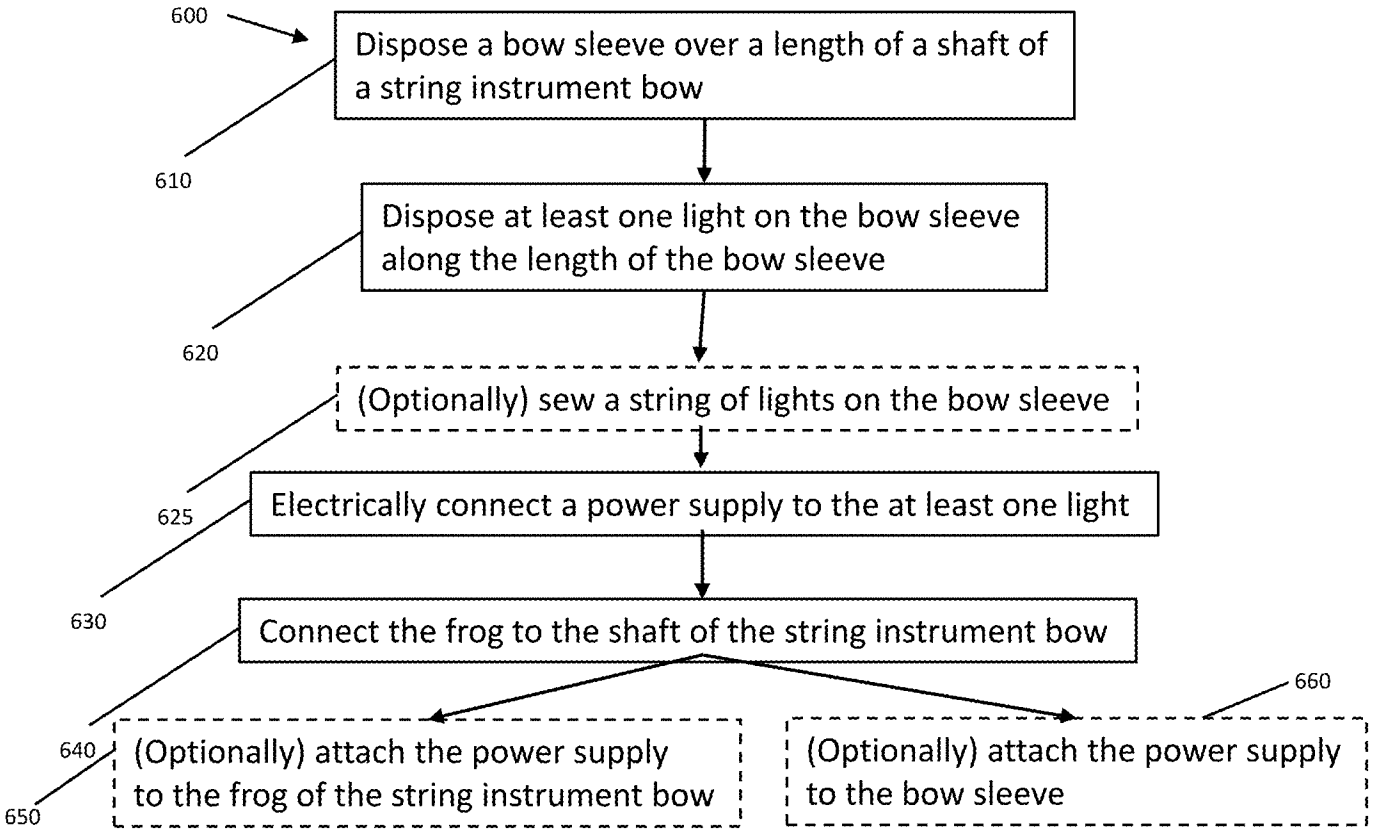
FIG. 6 is a flow chart of a method of making a string instrument bow light in accordance with one or more embodiments.

In accordance with one or more embodiments, a method 600 of making a string instrument bow light, shown in FIG. 6, includes disposing 610 a bow sleeve over a length of a shaft of a string instrument bow, the length of the shaft spanning between a frog and a tip of the string instrument bow, disposing 620 at least one light on the bow sleeve along a length of the bow sleeve, the sleeve length being at least approximately 80% of the length of the shaft, electrically connecting 630 a power supply to the at least one light, and connecting 640 the frog to the shaft of the string instrument bow. In some embodiments, the method can further include sewing 625 the at least one light on the bow sleeve, such as sewing 625 a string of lights on the bow sleeve. In certain embodiments, the method can further include attaching 650 the power supply to the frog of the string instrument bow. In other embodiments, the method can further include attaching 660 the power supply to the bow sleeve, such as by sewing the power supply onto the bow sleeve.

EQUIVALENTS

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Additionally, elements and components described herein may be further divided into additional components or joined together to form fewer components for performing the same functions.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future filed applications claiming priority to this application may claim the disclosed subject matter in a different manner, and may generally include any set of one or more limitations as variously disclosed or otherwise demonstrated herein.

What is claimed is:

1. An article comprising:

(a) at least one light configured to be disposed on a length of a shaft of a standard string instrument bow suitable for playing a string instrument, the length of the shaft spanning between a frog and a tip of the standard string instrument bow; and (b) a power supply electrically connected to the at least one light.

2. The article of claim 1, wherein the at least one light is a light emitting diode (LED).

3. The article of claim 1, wherein the at least one light is one light substantially spanning the length of the shaft.

4. The article of claim 1, wherein the at least one light is a plurality of lights, substantially spanning the length of the shaft.

5. The article of claim 4, wherein the plurality of lights is configured to light in a sequential pattern along the length of the shaft.

6. The article of claim 4, wherein the plurality of lights is configured to flash on and off.

7. The article of claim 4, wherein the plurality of lights is uniformly spaced at least 0.5 inches apart along the length of the shaft.

8. The article of claim 7, wherein the plurality of lights is uniformly spaced 1.5 inches apart along the length of the shaft.

9. The article of claim 1, further including a bow sleeve disposed over the shaft of the standard string instrument bow, with the at least one light disposed on the sleeve along a length of the sleeve, the sleeve length being at least about 80% of the length of the shaft.

10. The article of claim 9, wherein the power supply is attached to the bow sleeve.

11. The article of claim 9, wherein the power supply is attached to the frog of the standard string instrument bow.

12. The article of claim 11, further including a clip that clamps around the frog.

13. The article of claim 12, wherein the clip is extended to clamp around the power supply.

14. The article of claim 12, wherein the power supply is attached to the clip.

15. The article of claim 12, further including a protective layer between the clip and the frog.

16. The article of claim 1, wherein the power supply is integrated into a wrist band.

17. The article of claim 1, wherein the string instrument is one of a violin, a viola, a cello, a double bass, a chin cello, and a viola da gamba.

18. The article of claim 1, further including at least one light clip that attaches the at least one light to the shaft of the standard string instrument bow, the at least one light clip including a protective layer between the light clip and the shaft suitable for protecting the surface of the shaft.

19. The article of claim 1, further including a power supply clip that attaches the power supply to the shaft of the standard string instrument bow, the power supply clip including a protective layer between the power supply clip and the shaft suitable for protecting the surface of the shaft.

20. A method of making an article, the method comprising:

(a) disposing a bow sleeve over a length of a shaft of a string instrument bow, the length of the shaft spanning between a frog and a tip of the string instrument bow;

(b) disposing at least one light on the bow sleeve along a length of the bow sleeve, the sleeve length being at least about 80% of the length of the shaft;

(c) electrically connecting a power supply to the at least one light; and (d) connecting the frog to the shaft of the string instrument bow.

21. The method of claim 20, further including sewing the at least one light on the bow sleeve.

22. The method of claim 21, further including sewing a string of lights on the bow sleeve.

23. The method of claim 20, further including attaching the power supply to the frog of the string instrument bow.

24. The method of claim 20, further including attaching the power supply to the bow sleeve.

* * * * *